US009586245B2

(12) United States Patent
Kurz

(10) Patent No.: US 9,586,245 B2
(45) Date of Patent: Mar. 7, 2017

(54) OPERATING METHOD FOR A ROLLING TRAIN

(75) Inventor: Matthias Kurz, Erlangen (DE)

(73) Assignee: PRIMETALS TECHNOLOGIES GERMANY GMBH, Erlangen (DE)

( * ) Notice: Subject to any disclaimer, the term of this patent is extended or adjusted under 35 U.S.C. 154(b) by 566 days.

(21) Appl. No.: 14/119,986

(22) PCT Filed: Apr. 27, 2012

(86) PCT No.: PCT/EP2012/057814

§ 371 (c)(1),
(2), (4) Date: Nov. 25, 2013

(87) PCT Pub. No.: WO2012/159849

PCT Pub. Date: Nov. 29, 2012

(65) Prior Publication Data

US 2014/0100686 A1 Apr. 10, 2014

(30) Foreign Application Priority Data

May 24, 2011 (EP) ..... 11167282

(51) Int. Cl.
*B21B 37/00* (2006.01)
*B21B 37/28* (2006.01)
*B21B 37/68* (2006.01)

(52) U.S. Cl.
CPC ..... *B21B 37/00* (2013.01); *B21B 37/28* (2013.01); *B21B 37/68* (2013.01); *B21B 2263/02* (2013.01)

(58) Field of Classification Search
CPC .. B21B 1/24; B21B 1/34; B21B 37/00; B21B 37/16; B21B 37/28; B21B 37/46;
(Continued)

(56) References Cited

U.S. PATENT DOCUMENTS 4,392,371 A * 7/1983 Okumura ..... B21B 37/165 72/231
4,674,309 A 6/1987 Fabian et al.
(Continued)

FOREIGN PATENT DOCUMENTS

CN 101080286 11/2007
CN 102510779 6/2012
(Continued)

OTHER PUBLICATIONS

Opposition to a European Patent mailed Jun. 17, 2015 in European Patent Application No. 12718185.7.
(Continued)

*Primary Examiner* — Kenneth M Lo
*Assistant Examiner* — Michael J Huntley
(74) *Attorney, Agent, or Firm* — Staas & Halsey LLP

(57) ABSTRACT

A control computer for a rolling train is supplied with prescribed stand parameters of a rolling stand of the rolling train. The control computer sets variables describing a rolling pass of the rolling stand that together with initial data of a flat piece to be rolled and the stand data describe the resultant roll nip and the asymmetry thereof. The initial data may be width, average thickness and average strength of the workpiece to be rolled. Based on the initial data, the stand data and the set variables an expected delivery taper and/or an expected strip sabre for the workpiece is determined. At least one of the set variables is manipulated to bring the determined delivery taper close to a desired delivery taper and/or the strip sabre close to a desired strip sabre. The manipulated variables are used to control rolling the workpiece piece.

13 Claims, 6 Drawing Sheets

(58) Field of Classification Search
CPC ..... B21B 37/58; B21B 37/68; B21B 38/00; B21B 38/12; B21B 38/105; B21B 2015/0014; B21B 2015/0071; B21B 2263/02; B21B 2265/22
See application file for complete search history.

(56) References Cited

U.S. PATENT DOCUMENTS

| | | | | |
|---|---|---|---|---|
| 4,912,954 | A * | 4/1990 | Vegter | B21B 37/16 700/149 |
| 5,101,650 | A * | 4/1992 | Fapiano | B21B 37/16 700/151 |
| 5,502,992 | A * | 4/1996 | Sorgel | B21B 37/28 72/10.1 |
| 5,873,277 | A * | 2/1999 | Bruestle | B21B 37/42 72/11.4 |
| 5,963,918 | A * | 10/1999 | Reagan | G06Q 10/063 705/22 |
| 5,987,948 | A * | 11/1999 | Neushutz | B21B 37/00 72/365.2 |
| 6,098,060 | A | 8/2000 | Yuan et al. | |
| 6,263,714 | B1 * | 7/2001 | Johnson | G05D 5/03 72/10.3 |
| 6,327,883 | B1 * | 12/2001 | Noe | B21B 37/32 72/12.2 |
| 6,438,443 | B1 * | 8/2002 | Berghs | B21B 37/28 700/148 |
| 6,571,134 | B1 * | 5/2003 | Gramckow | B21B 37/28 700/128 |
| 6,619,092 | B2 * | 9/2003 | Nakayama | B21B 1/24 72/234 |
| 6,782,304 | B1 * | 8/2004 | Tsugeno | B21B 37/16 700/149 |
| 6,840,076 | B2 * | 1/2005 | Noe | B21B 1/28 72/161 |
| 6,856,855 | B2 * | 2/2005 | Hirata | B29C 47/0021 700/196 |
| 7,854,154 | B2 * | 12/2010 | Pawelski | B21B 37/00 72/10.4 |
| 7,980,109 | B2 * | 7/2011 | Perret | B21B 38/00 72/11.5 |
| 8,347,681 | B2 * | 1/2013 | Broussard | B21B 37/16 700/149 |
| 8,365,565 | B2 * | 2/2013 | Noe | B21D 1/05 72/160 |
| 8,676,371 | B2 * | 3/2014 | Botta | B21B 37/48 242/418 |
| 9,095,886 | B2 * | 8/2015 | Simaan et al. | B21B 37/50 |
| 9,138,789 | B2 * | 9/2015 | Gruss | B21B 37/46 |
| 2004/0079127 | A1 * | 4/2004 | Seidel | B21B 37/72 72/12.5 |
| 2006/0041448 | A1 * | 2/2006 | Patterson | G06Q 10/101 705/301 |
| 2006/0207305 | A1 * | 9/2006 | Maruyama | B21B 37/20 72/9.3 |
| 2007/0068210 | A1 * | 3/2007 | Pittner | B21B 37/165 72/10.1 |
| 2010/0192660 | A1 | 8/2010 | Kurz et al. | |
| 2010/0242566 | A1 * | 9/2010 | Weisshaar | B21B 37/68 72/365.2 |
| 2014/0100686 | A1 * | 4/2014 | Kurz | B21B 37/28 700/150 |

FOREIGN PATENT DOCUMENTS

| | | | | |
|---|---|---|---|---|
| DE | 30 26 427 | | 1/1981 | |
| DE | 34 35 232 | A1 | 4/1986 | |
| DE | 196 18 712 | A1 | 11/1997 | |
| DE | 102004041328 | | 3/2006 | |
| DE | 199 80 248 | B4 | 2/2008 | |
| DE | 10 2007 035 283 | A1 | 1/2009 | |
| DE | 102007035283 | A1 * | 1/2009 | B21B 37/28 |
| DE | 10 2008 007 247 | A1 | 3/2009 | |
| DE | 102009043400 | | 4/2011 | |
| DE | 102009043401 | | 4/2011 | |
| EP | 1 372 875 | | 10/2002 | |
| EP | 1 188 493 | B1 | 6/2006 | |
| EP | 11167282.0 | | 5/2011 | |
| JP | 10-156415 | | 6/1998 | |
| JP | 10-263657 | | 10/1998 | |
| JP | 57-202912 | | 12/1998 | |
| JP | 11-10215 | | 1/1999 | |
| JP | 2002-126813 | | 5/2002 | |
| KR | 10-0919031 | | 9/2009 | |
| WO | WO 95/19591 | A1 | 7/1995 | |
| WO | WO 96/28770 | A1 | 9/1996 | |
| WO | WO 02/078872 | A1 | 10/2002 | |
| WO | 2006/063948 | | 6/2006 | |
| WO | PCT/EP2012/057814 | | 4/2012 | |

OTHER PUBLICATIONS

English language International Search Report for PCT/EP2012/057814, mailed Jul. 16, 2012, 2 pages.
European Office Action for European Priority Patent Application No. 11167282.0, issued Oct. 19, 2011, 6 pages.

* cited by examiner

OPERATING METHOD FOR A ROLLING TRAIN

CROSS REFERENCE TO RELATED APPLICATIONS

This application is based on and hereby claims priority to International Application No. PCT/EP2012/057814 filed on Apr. 27, 2012 and European Application No. 11167282.0 filed on May 24, 2011, the contents of which are hereby incorporated by reference.

BACKGROUND

The present invention relates to an operating method for a rolling train for rolling a flat workpiece in at least one rolling stand of the rolling train.

The present invention further relates to a computer program comprising machine code which can be directly executed by a control computer for a rolling train for rolling a flat workpiece.

The present invention further relates to a control computer for a rolling train for rolling a flat workpiece.

The present invention further relates to a rolling train for rolling a flat workpiece, said rolling train being equipped with such a control computer.

Such subject matter is disclosed in WO 2006/063 948 A1, for example.

According to the known operating method, the set variables are used in conjunction with the initial data, which describes the flat workpiece before rolling in the rolling stand, and the stand data of the rolling stand, to describe the resultant roll nip during the rolling of the flat workpiece in the rolling stand. As part of the rolling schedule calculation on the basis of the initial data, the stand data and the set variables, the control computer determines, by a model, expected variables which are expected for the flat workpiece when the flat workpiece is rolled in the rolling stand using the set variables. As part of the rolling schedule calculation, the control computer varies at least one of the set variables according to a strategy, such that the determined expected variables are brought at least close to the final variables. The control computer transfers the varied variables that are determined by the rolling schedule to a basic automation system of the rolling stand, such that the flat workpiece is rolled in the rolling stand in accordance with the varied variables.

DE 10 2009 043 400 A1 discloses a system for model-based determination of desired actuator values for a hot broad strip train comprising a plurality of rolling stands. According to this system, a desired target contour of the roll nips of the stands can be adjusted by implementing the desired actuator values. In a first part of the method of this system, a desired speed taper of the hot strip after each stand is prescribed. In the second part of the method, strip flatness models are used to determine values for strip thickness contours on the delivery side of the stands. In the third part of the method, rolling force distributions that must be applied for each stand are specified by material flow models. In the fourth part of the method, the target contour is determined for the strip travel actuators. In the fifth part of the method, the desired actuator values for each stand are calculated from the target contour by an optimization method.

The method described in DE 10 2009 043 400 A1 is applied while the flat workpiece is passing through a multi-stand rolling train. Measurement variables on both feed and delivery sides of all participating rolling stands are required in order to perform the method.

Equivalent contents are disclosed in DE 10 2009 043 401 A1.

When rolling metal, the shape of the workpiece is an important variable from the beginning of the process onwards and via all of the intermediate process. In addition to thickness, width, profile and flatness, the taper (i.e. the asymmetric portion of the thickness over the width of the flat workpiece) and the camber (i.e. the curvature of the flat workpiece in the rolling plane) are also important characteristic variables. Both taper and camber are undesirable, since these variables (when not equal to 0) complicate and even in some circumstances prevent the subsequent process or result in spoilage.

The taper and the camber are also closely linked as a result of the material retention. For example, if a slab which is cold on one side enters the rolling stand, the colder side is rolled less effectively than the hotter side due to the greater rolling force on one side and the associated greater frame stretch of the rolling stand on one side (in the absence of any other control intervention). This causes a thickness taper and a corresponding camber to develop. However, if an already tapered flat workpiece enters the rolling stand and the thickness taper is eliminated during the rolling of the flat workpiece, a camber is generated by the rolling.

If the flat workpiece already has a thickness taper, the related art often provides for the upper set of rollers and the lower set of rollers to be swiveled relative to each other, such that the relative taper is retained during the rolling pass and consequently no curvature (=camber) is generated. The swiveling is effected manually by an operator on the basis of the observation of the workpiece. Methods which automatically support the operator by anticipating or at least limiting these manual interventions are also known. These methods are based on measurements of differential rolling forces and adjustments, and are therefore implemented in the context of the basic automation system.

In the case of tapered slabs, i.e. slabs having a thickness taper, methods are also known which eliminate the taper while nonetheless preventing the development of a camber by imposing asymmetrical tension distributions. This is achieved by producing a cross flow in the material.

It is difficult or even impossible, solely on the basis of the rolling force signal, to determine a desired value for a correction element by which the delivery taper can be corrected.

SUMMARY

One potential object is to provide possibilities by which a delivery taper and/or a delivery-side camber can be effectively predicted and flexibly adjusted.

The inventor proposes an operating method for a rolling train for rolling a flat workpiece in at least one rolling stand of the rolling train,

- wherein stand data describing stand parameters of the rolling stand is prescribed to a control computer for the rolling train,
- wherein as part of a rolling schedule calculation, the control computer sets variables which describe the rolling of the flat workpiece in the rolling stand,
- wherein the set variables, the initial data which describes the flat workpiece before rolling in the rolling stand, and the stand data of the rolling stand together describe the resultant roll nip and the asymmetry thereof during the rolling of the flat workpiece in the rolling stand, wherein the initial data comprises characteristic variables at least for the width, the average thickness and the average strength of the flat workpiece, wherein as part of the rolling schedule calculation, on the basis of the initial data, the stand data and the set variables, by a taper model, the control computer determines an expected delivery taper and/or an expected camber for the flat workpiece when the flat workpiece is rolled in the rolling stand using the set variables. In this method a taper strategy is externally prescribed to the control computer, the variables describing the rolling of the flat workpiece in the rolling stand are additionally characteristic of at least one further rolling stand variable which influences the rolling contour, and the offset of the flat workpiece relative to the rolling stand center, the control computer determines a rolling contour portion on the basis of the total rolling force, the rolling force difference between drive side and operator side, the further rolling stand variables, the width of the flat workpiece and the offset of the flat workpiece relative to the rolling stand center, a tilt portion on the basis of the screw-down difference between drive side and operator side and a stand frame stretch difference between drive side and operator side, and the delivery taper and/or the camber on the basis of the rolling contour portion and the tilt portion, as part of the rolling schedule calculation, the control computer varies at least one of the set variables in accordance with the prescribed taper strategy, such that the determined delivery taper is brought at least close to a desired delivery taper and/or the camber is brought at least close to a desired camber, and the control computer transfers the varied variables that are determined by the rolling schedule calculation to a basic automation system of the rolling stand, such that the flat workpiece is rolled in the rolling stand in accordance with the varied variables.

Depending on requirements, the taper strategy can be aimed at e.g. retaining the relative taper, a taper=0, restricting a camber, etc.

The further rolling stand variables can also be specified if required. In particular, these may include a roller reverse bending force and/or a convexity of rollers of the rolling stand and/or a relative transposition and/or displacement of the rollers of the rolling stand.

The variables which describe the rolling of the flat workpiece in the rolling stand can be supplemented by further variables. The further variables can comprise e.g. the feed-side tension and/or the delivery-side tension in the flat workpiece and/or the corresponding differences between drive side and operator side and/or the corresponding distributions over the width of the flat workpiece.

Provision is preferably made for the control computer to determine a deflection curve portion on the basis of the total rolling force, the rolling force difference between drive side and operator side, the further rolling stand variables, the width of the flat workpiece and the offset of the flat workpiece relative to the rolling stand center, a flattening portion on the basis of the total rolling force, the rolling force difference between drive side and operator side and the width of the flat workpiece, and the rolling contour portion on the basis of the deflection curve portion and the flattening portion.

By virtue of this procedure, the rolling contour portion can be determined particularly efficiently, i.e. with relatively little computing effort.

In a preferred embodiment, provision is made for the stand parameters of the rolling stand to comprise an individual frame stretch characteristic for the drive side and operator side in each case. This embodiment allows particularly flexible modeling of the delivery taper and/or the camber.

The initial data can be purely symmetrical data, e.g. characterizing the average thickness and the average strength of the flat workpiece. However, the initial data can also comprise characteristic variables for a strength taper (e.g. a temperature taper) and/or for a thickness taper and/or for a (feed-side) camber of the flat workpiece.

The desired delivery taper and/or the desired camber may be permanently prescribed at the control computer. For example, the desired delivery taper and/or the desired camber may be prescribed as 0. Alternatively, the desired delivery taper and/or the desired camber may be explicitly prescribed to the control computer. Alternatively, the control computer may also determine the desired delivery taper using the initial data of the flat workpiece. In this case, the control computer can preserve the relative taper in particular, i.e. the relationship between thickness taper and average thickness of the flat workpiece.

Depending on the current rolling operation, provision may be made for performing the operating method just once for each flat workpiece. However, the control computer preferably determines the respective delivery taper for a plurality of positions over the length of the flat workpiece and varies at least one of the set variables according to the taper strategy. In particular, this procedure is advantageous if the flat workpiece is a strip. However, it is likewise applicable if the flat workpiece is a thick plate.

In a preferred embodiment, the control computer receives rolling stand states that occur during the rolling of the flat workpiece in the rolling stand, and/or characteristic variables for the actual delivery taper and/or the actual camber of the flat workpiece during and/or after the rolling of the flat workpiece in the rolling stand. In this case, the control computer can use the received variables in particular for the purpose of determining part (or directly as part) of the initial data of the flat workpiece for at least one subsequent rolling operation of the same flat workpiece in the same or a different rolling stand, adapting the taper model, and/or visually depicting the actual delivery taper and/or the actual camber of the flat workpiece.

The inventor further proposes a computer program of the type cited in the introduction. In this case, the computer program is embodied such that the control computer executes the proposed operating method.

The inventor proposes a control computer for a rolling train for rolling a flat workpiece, said control computer being so designed as to execute such an operating method during operation.

The object is further achieved by a rolling train for rolling a flat workpiece, said rolling train being equipped with such a control computer.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
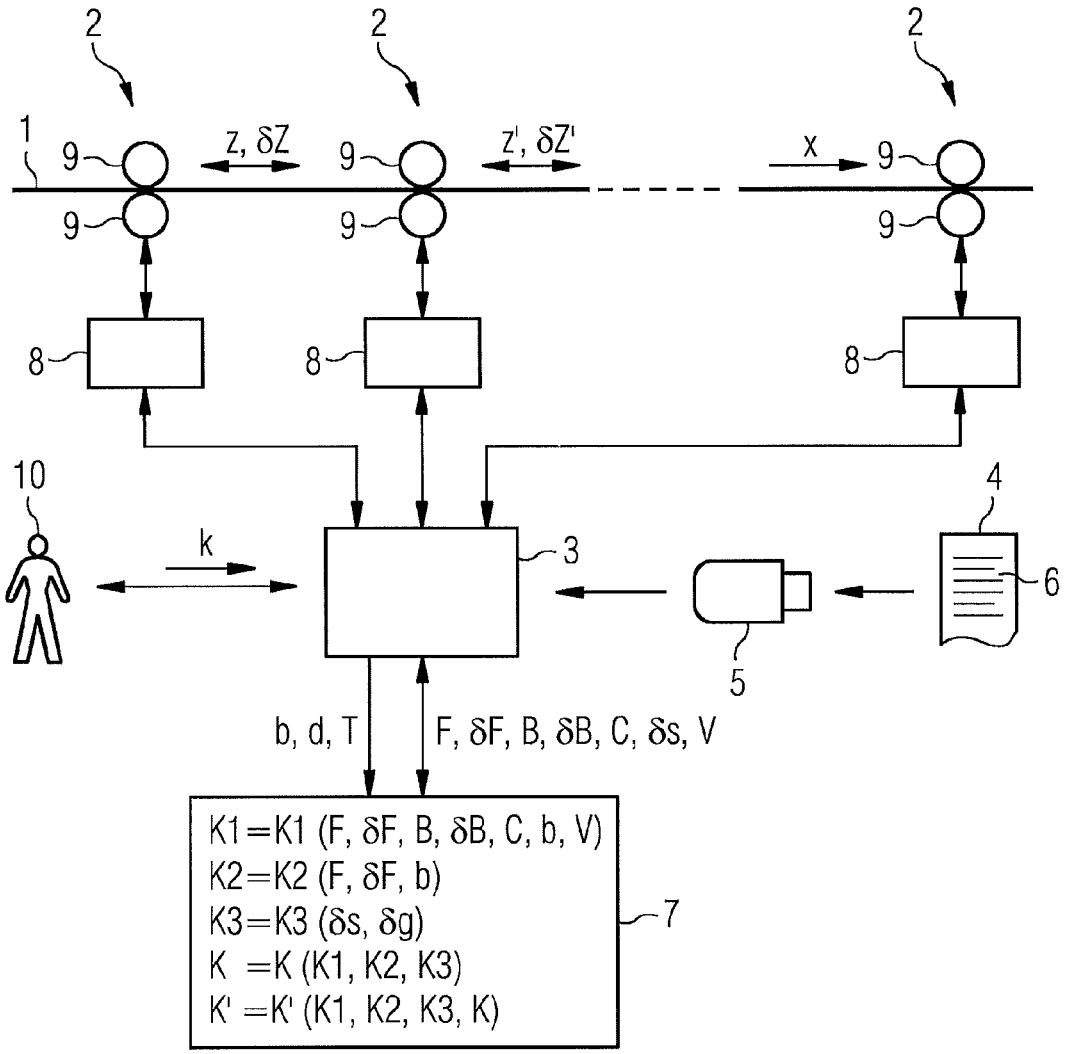
FIG. 1 schematically shows a rolling train.

Reference will now be made in detail to the preferred embodiments of the present invention, examples of which are illustrated in the accompanying drawings, wherein like reference numerals refer to like elements throughout.

FIG. 1 shows a rolling train for rolling a flat workpiece 1. The rolling train according to FIG. 1 takes the form of a multi-stand rolling train which has a plurality of (normally four to eight) rolling stands 2. The flat workpiece 1 is rolled in the rolling stands 2 of the rolling train.

The rolling train is equipped with a control computer 3. The control computer 3 is so designed as to operate the rolling train in accordance with the proposed operating method. The operating method is explained in greater detail below. The corresponding configuration of the control computer 3 is achieved using a computer program 4 by which the control computer 3 is programmed. The computer program 4 can be stored on a suitable data medium 5 for this purpose, said data medium being represented purely for exemplary purposes as a USB memory stick in FIG. 1. The storage on the data medium 5 takes place in machine-readable form, normally in exclusively machine-readable form, e.g. in electronic form. The computer program 4 comprises machine code 6. The machine code 6 can be directly executed by the control computer 3. The execution of the machine code 6 by the control computer 3 causes the control computer 3 to operate the rolling train in accordance with the operating method.

Figure 2:
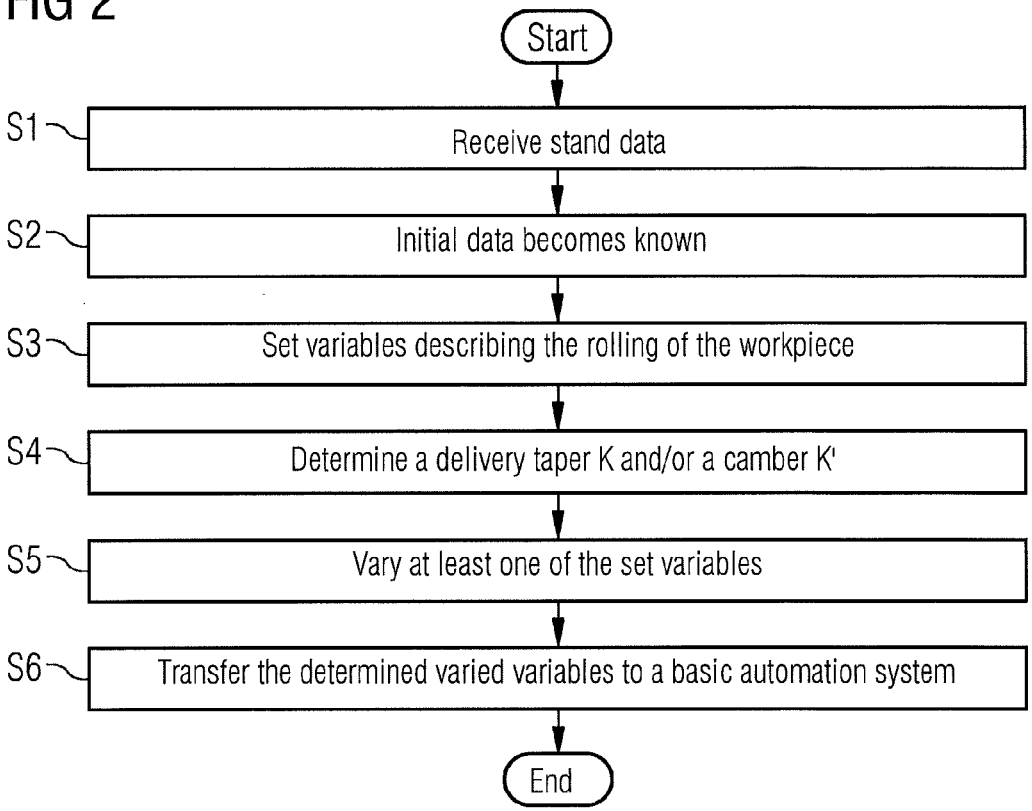
FIGS. 2 to 5 show flow diagrams.

As shown in FIG. 2, and still with reference to FIG. 1, stand data is prescribed to the control computer 3 in S1. The stand data describes stand parameters of a rolling stand 2 which performs a specific rolling operation, in particular the frame stretch characteristic thereof.

In S2, initial data for the specific rolling operation in the specific rolling stand 2 becomes known to the control computer 3, wherein said initial data describes the flat workpiece 1 before rolling in the relevant rolling stand 2. The initial data comprises at least the width b, the average thickness d and a characteristic variable, e.g. the temperature T, for the average strength of the flat workpiece 1. The initial data may be externally prescribed to the control computer 3. Alternatively, the control computer 3 may determine the initial data itself. For example, the initial data may be derived completely or partly from a previous rolling operation which was performed before the current rolling operation. This is explained in greater detail below. The control computer 3 may perform S2 as part of a rolling schedule calculation.

In S3, as part of the rolling schedule calculation, the control computer 3 sets variables which describe the rolling of the flat workpiece 1 in the relevant rolling stand 2. Since the control computer 3 performs S3 as part of the rolling schedule calculation, the control computer 3 performs S3 before the rolling of the workpiece 1 is started in the corresponding rolling stand 2.

Used in conjunction with the initial data d, b, T of the flat workpiece 1 and the stand data of the relevant rolling stand 2, the set variables describe the resultant roll nip in the relevant rolling stand 2 during the rolling of the flat workpiece 1. They also describe the asymmetry of the roll nip in the direction of the roller axes. In S4, as part of the rolling schedule calculation, on the basis of the initial data b, d, T, the stand data and the set variables, the control computer 3 is therefore able by a taper model 7 to determine a delivery taper K which is expected for the flat workpiece 1 when the flat workpiece 1 is rolled in the relevant rolling stand 2 using the set variables. It is alternatively or additionally possible by the taper model 7 to determine a camber K' which is expected for the flat workpiece 1 when the flat workpiece 1 is rolled in the rolling stand 2 using the set variables.

The taper model 7 comprises mathematical-physical equations which describe the behavior of the rolling stand 2 and the flat workpiece 1. It is likewise realized by the computer program 4 or the machine code 6.

The term "delivery taper" has the following meaning: a delivery taper is the asymmetric portion of the thickness function viewed over the strip width b. The term "camber" means the curvature of the flat workpiece 1 to the side.

In S5, as part of the rolling schedule calculation, the control computer 3 varies at least one of the set variables in accordance with a taper strategy. The variation is effected such that the determined delivery taper K is brought at least close to a desired delivery taper. Alternatively or additionally, the determination can be effected such that the camber K' is brought close to a desired camber.

Figure 3:
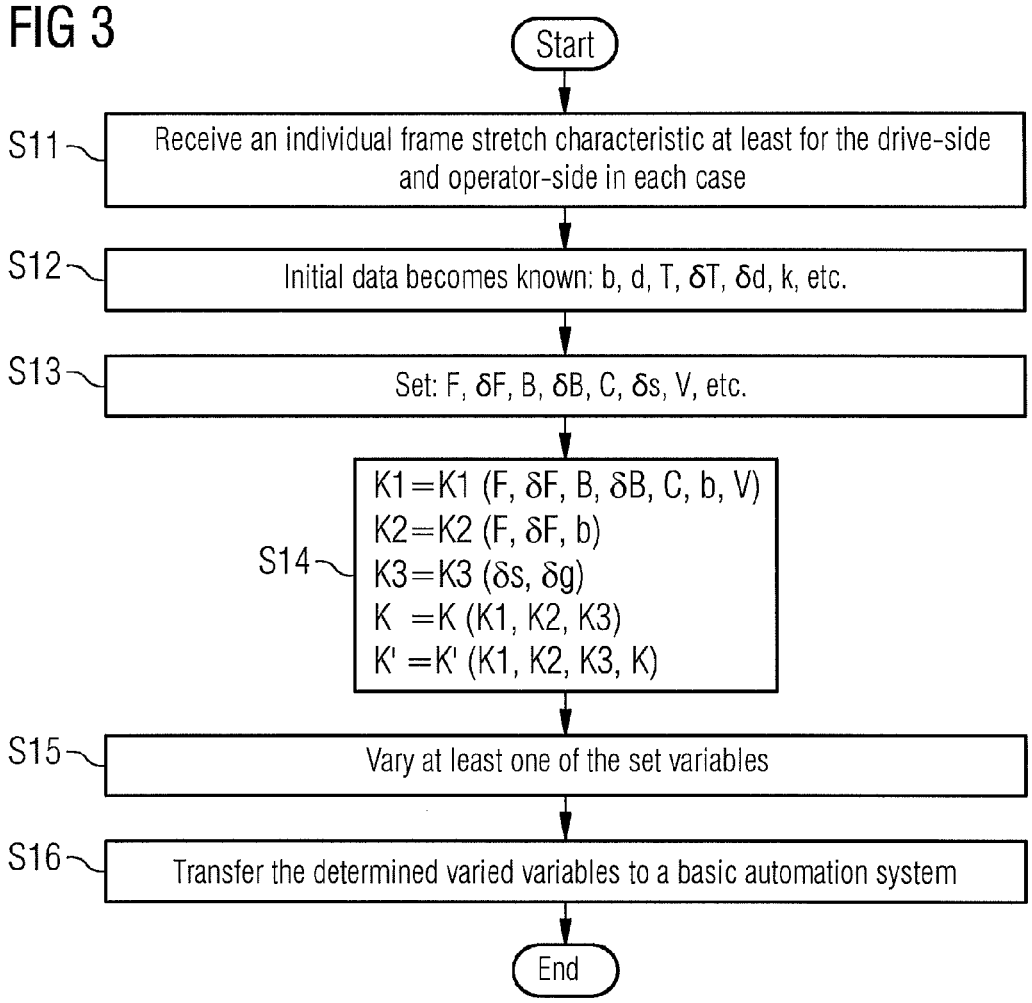

In S6, as part of the rolling schedule calculation, the control computer 3 transfers the determined varied variables to a basic automation system 8 of the relevant rolling stand 2. In addition, the functional dependencies of the delivery taper K and/or the camber K' on the set variables are usually transferred at the same time. The basic automation system 8 is therefore able to operate the relevant rolling stand 2 in accordance with the varied variables while the flat workpiece 1 passes through the relevant rolling stand 2. In S6 is also performed by the control computer 3 before the flat workpiece 1 is rolled in the relevant rolling stand 2. The operating method is explained again below in connection with FIG. 3. FIG. 3 comprises S11 to S16. S11 to S16 correspond in principle to S1 to S6 from FIG. 2. However, S11 to S16 show more precise embodiments than S1 to S6.

The embodiment of S11 to S16 may be realized independently in each case. For example, the more specific embodiment of S11 does not have to be combined with the more specific embodiment of S13. It is possible to combine the sequence of S11 and S2 to S6, for example, or the sequence of S1, S2, S13 and S4 to S6, etc.

The stand data is stipulated in S11 in a similar way to S1. According to S11, the stand parameters of the rolling stand 2 include an individual frame stretch characteristic separately for the drive side and the operator side in each case.

In the step S12, the variables b, d, T already cited in connection with S2 become known to the control computer 3. The initial data may also comprise e.g. a strength taper, in particular a temperature taper $\delta T$, and/or a thickness taper $\delta d$. In addition, a characteristic variable for a feed-side camber of the flat workpiece 1 can also become known at the same time, e.g. a corresponding curvature k.

Moreover, further data can become known to the control computer 3 in S12, e.g. the desired taper and/or the desired camber or maximal permissible values for the delivery taper and/or the delivery-side camber.

The step S13 shows some of the set variables. According to S3, the set variables are characteristic of at least the total rolling force F. The set variables are preferably also characteristic of the rolling force difference δF between drive side and operator side. Other possible set variables include further rolling stand variables B, C, δB affecting the rolling contour, and the screw-down difference δs between drive side and operator side. An offset V may also be set at the same time. The offset V specifies the extent to which the flat workpiece 1 is offset relative to the rolling stand center when it enters the relevant rolling stand 2.

According to S14, the control computer 3 determines a deflection curve portion K1 on the basis of the total rolling force F, the rolling force difference δF, the further rolling stand variables B, C, δB, the width b of the flat workpiece 1 and the offset V. In S14, the control computer 3 further determines a flattening portion K2 on the basis of the total rolling force F, the rolling force difference δF and the width b of the flat workpiece 1. Also in the context of S14, the control computer 3 determines a tilt portion K3 on the basis of the screw-down difference δs and a stand frame stretch difference δg between drive side and operator side. The control computer 3 then determines the delivery taper K on the basis of the deflection curve portion K1, the flattening portion K2 and the tilt portion K3. If the initial data also includes values for the feed-side taper and the feed-side camber, and the feed-side and delivery-side tensions and their differences or distributions are also known or a material cross flow is excluded, it is also possible to determine the delivery-side camber K'.

S15 and S16 are identical to S5 and S6 from FIG. 2.

As an alternative to the procedure as per step S14, in which the deflection curve portion K1 and the flattening portion K2 are determined separately, it is possible directly to determine a rolling contour portion that corresponds to the sum of deflection curve portion K1 and flattening portion K2. This procedure, if required, may be realized e.g. as follows:

The rollers 9 of the rolling stand 2 concerned are divided into finite elements. A matrix is determined which relates a given displacement of the finite elements from a respective neutral position to the resulting pressure distribution in the roll nip (so-called elastic equations). This matrix is inverted such that the associated contour profile of the roll nip can be determined on the basis of a given rolling force distribution. The corresponding procedure for determining the matrix and its inversion are known to a person skilled in the art. A similar procedure is possible if a transition between two rollers 9 of the rolling stand 2 applies instead of or in addition to the transition of the workpiece 1 to the working roller 9. A similar procedure is also possible if the displacements are set as a continuous function (so-called Green's function).

Figure 4:
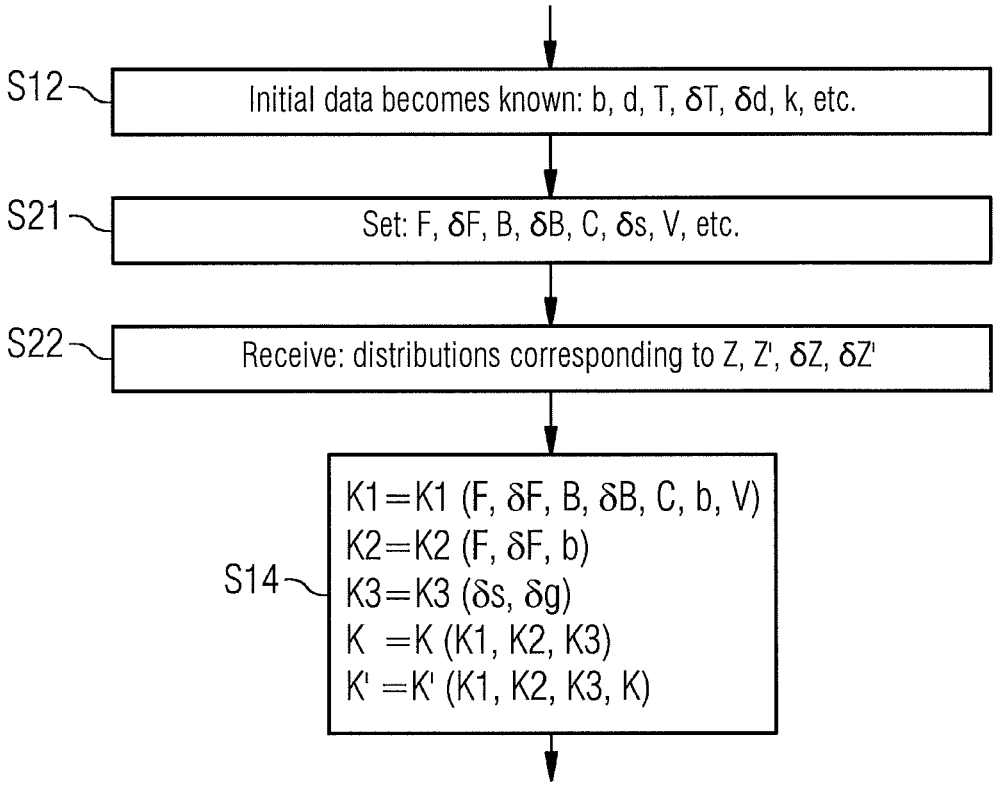

FIG. 4 shows further possible embodiments of S13 from FIG. 3. In a similar way to the relationship between FIGS. 2 and 3, S21 and S22 can also be realized as alternatives.

Possible further rolling stand variables are illustrated in S21. According to S21, the further rolling stand variables may include at least one of the following variables:

- a roller reverse bending force B,
- the difference δB between drive side and operator side if applicable,
- a (temperature and wear-dependent) convexity C of rollers 9 of the relevant rolling stand 2,
- a displacement of the rollers 9 of the relevant rolling stand 2 in the direction of the roller axes, and
- a transposition of the rollers 9 of the rolling stand 2 relative to each other, i.e. a mutually opposing swiveling of the rollers 9 of the rolling stand 2 in and against a direction of travel x of the workpiece.

It is possible actively to influence the convexity C by local cooling of the rollers 9.

According to S22, it is further possible to prescribe additional variables to the control computer 3, said variables describing the rolling of the flat workpiece 1 in the relevant rolling stand 2. In particular, at least one of the following variables can be prescribed to the control computer 3:

- the feed-side tension Z in the flat workpiece 1,
- the delivery-side tension Z' in the flat workpiece 1,
- the corresponding differences δZ, δZ' between drive side and operator side, and
- the corresponding distributions over the width b of the flat workpiece 1.

The operating method can be embodied in various ways. Examples of such embodiments are illustrated in FIG. 5.

Figure 5:
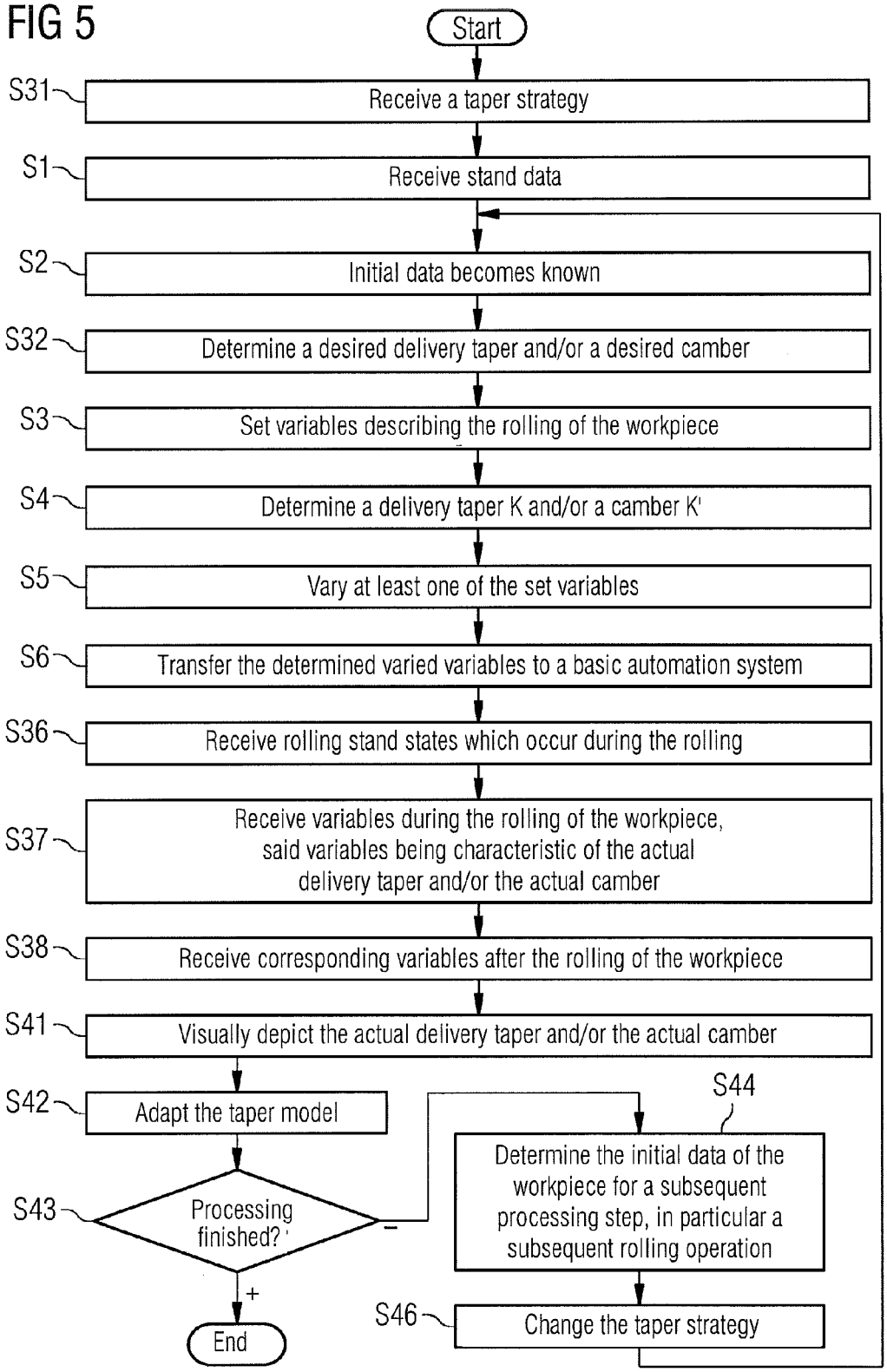

FIG. 5 shows various possible embodiments. The embodiments can be realized independently of each other. The possible embodiments illustrated in the context of FIG. 5 still include S1 to S6, which were already explained in FIG. 2. Alternatively, S11 to S16 from FIG. 3 could also be used, together or individually, possibly in the embodiments according to FIG. 4.

According to FIG. 5, S31 is also present. In S31, the taper strategy is prescribed to the control computer 3. For example, it may be prescribed to the control computer whether said control computer is to adjust the delivery taper K and/or the camber K' to 0, whether it is to preserve an existing relative asymmetry (and in which distribution in respect of delivery taper K and camber K' if applicable), etc.

A step S32 is also present. In S32, the control computer 3 uses the initial data of the flat workpiece 1 to determine the desired delivery taper and/or the desired camber. In particular, if e.g. the flat workpiece 1 already has a taper and/or a camber before it is rolled in the relevant rolling stand 2 and moreover a material cross flow is no longer possible or is only possible to a limited extent due to the thickness d of the workpiece 1, the control computer 3 can prescribe the desired taper and the desired camber such that the desired camber remains in the acceptable range and the desired taper describes the remaining asymmetry of the flat workpiece 1. It follows that the desired taper and/or the desired camber are only determined in the context of S32 if the desired taper and/or the desired camber are not already prescribed and fixed as such by the taper strategy.

S36 to S38 (or at least one of S36 to S38) may also be present.

In S36, the control computer 3 receives rolling stand states which occur during the rolling of the flat workpiece 1 in the relevant rolling stand 2. For example, the control computer 3 can receive the actual rolling forces and/or the actual rolling force differences or the corresponding values of the reverse bending force.

In S37, the control computer 3 can receive variables during the rolling of the flat workpiece 1 in the relevant rolling stand 2, which variables are characteristic of the actual delivery taper and/or the actual camber of the flat workpiece 1. For example, the actual delivery-side tension or its difference or distribution can be captured and supplied to the control computer 3.

In S38, corresponding variables can be received following the rolling of the flat workpiece 1. For example, the flat workpiece 1 can be measured if applicable after rolling is completed in the relevant rolling stand 2. It is also possible for suitable variables to be measured at one position or at a plurality of positions downstream of the rolling stand 2, and for the actual delivery-side curvature of the flat workpiece 1 to be deduced on the basis of the variables. Corresponding procedures are known to a person skilled in the art.

The control computer 3 can use the variables received in the context of S36, S37 and/or S38 for various purposes. For example, in S41, the control computer 3 can output a visual depiction of the actual delivery taper and/or the actual camber of the flat workpiece 1 to an operator 10 via a visual display terminal or a printer, for example. Alternatively or additionally, in S42, the control computer 3 can compare the actual received variables with corresponding expected variables and adapt the taper model 7 on the basis of the comparison.

The control computer 3 can also use the received variables to determine actual states of the flat workpiece 1 and take these into consideration in the context of subsequent processing. For example, in S43, the control computer 3 can check whether the processing of the flat workpiece 1 has finished. If this is not the case, the control computer 3 can go to S44, in which the control computer 3 uses the initial data of the flat workpiece 1 for a subsequent processing step of the same flat workpiece 1, in particular a subsequent rolling operation, and/or determines at least part of the initial data of the flat workpiece 1 using this data. The subsequent rolling operation can be performed in the same or a different rolling stand 2, depending on the type of rolling train.

In the event that the rolling of the flat workpiece 1 is not yet finished, i.e. further rolling operations will take place, S46 may also be present. In S46, the control computer 3 can change the taper strategy if applicable. For example, the control computer can specify the taper strategy such that the delivery taper K and the camber K' are corrected if and for as long as the current thickness d of the flat workpiece 1 is greater than a critical thickness. However, if the thickness d of the flat workpiece 1 before rolling is (or becomes) smaller than the critical thickness, the control computer 3 can change the taper strategy such that the delivery taper K which is present at this time point is preserved after this time point. Other change options are also available.

Figure 6:
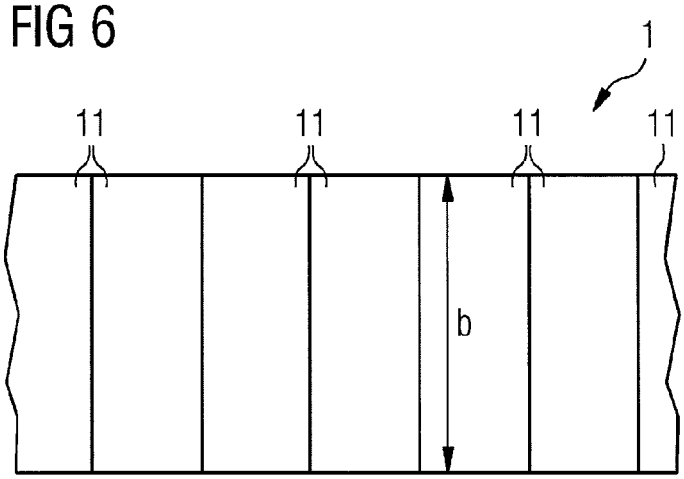
FIG. 6 shows a section of a flat workpiece.

The operating method might be performed just once for each flat workpiece 1. However, it is preferably performed more than once. In particular, the control computer 3 can specify a plurality of positions (sections 11) over the length of the flat workpiece 1 as per FIG. 6, and determine the respective delivery taper K and/or camber K' for each section 11, and vary at least one of the set variables (e.g. the rolling force difference δF or the offset V) in accordance with the currently specified taper strategy, thereby coming closer to a respective desired value. The control computer 3 may possibly perform the determination of the delivery taper K and/or the camber K' for all of the relevant sections 11 before the first section 11 of the workpiece 1 enters the relevant rolling stand 2. However, the control computer 3 performs the method for each section 11 at least at a time point before the respective section 11 enters the respective rolling stand 2 performing the rolling operation.

As described above in connection with FIGS. 1 to 6, a flat workpiece 1 is rolled in a multi-stand rolling train, wherein the workpiece direction of travel x is always the same. In such an embodiment of the rolling train, each rolling pass is performed in a different rolling stand 2 of the rolling train. This embodiment of the rolling train is therefore particularly suitable if the flat workpiece 1 is a strip. In principle, however, this procedure can also be applied if the flat workpiece 1 is a thick plate.

Figure 7:
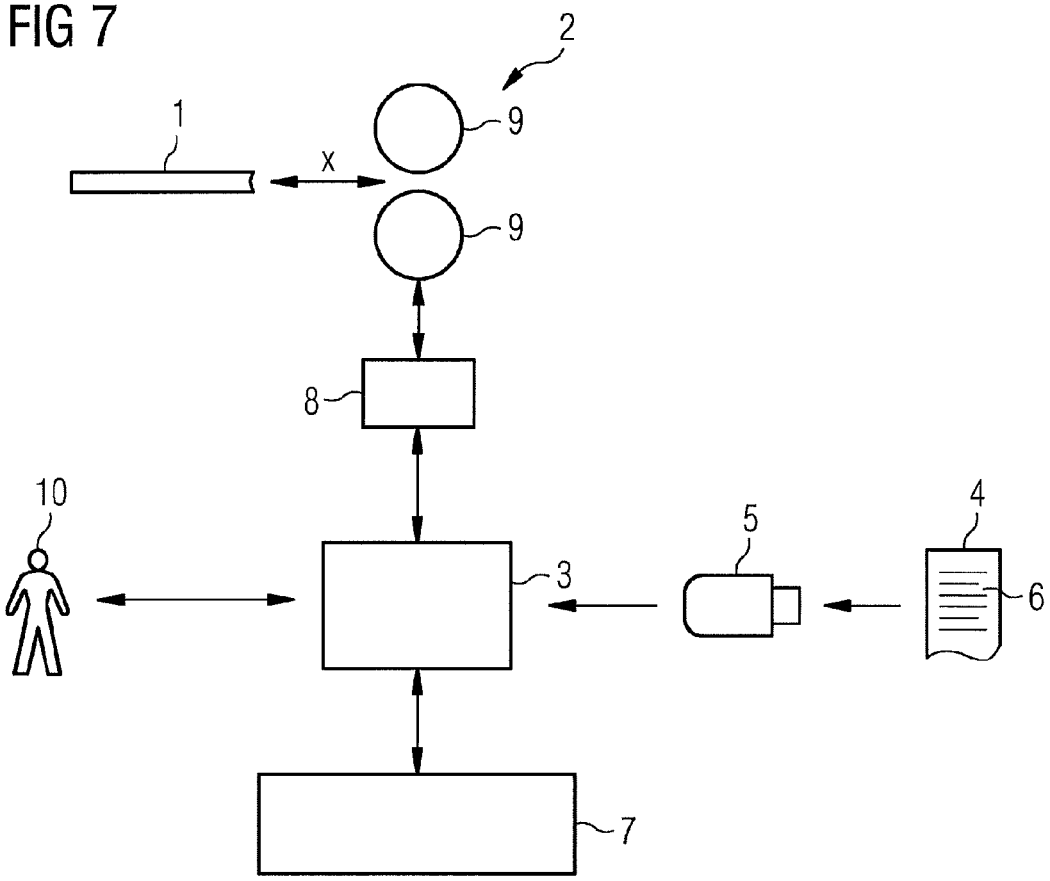
FIG. 7 schematically shows a further rolling train.

In principle, it is likewise possible for the rolling train to work in reversing mode and therefore be designed as a reversing rolling mill as per the illustration in FIG. 7. In this case, the individual rolling operations (rolling passes) take place in the same rolling stand 2, wherein the workpiece direction of travel x changes from rolling pass to rolling pass. This embodiment is particularly appropriate if the flat workpiece 1 is a thick plate. However, it can in principle be applied likewise if the flat workpiece 1 is a strip. In this case, the reversing rolling mill is preferably designed as a Steckel mill.

The proposals have many advantages. In particular, it allows selective determination of the delivery taper K and/or the camber K', and allows this determination to be included in the rolling schedule calculation.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in *Superguide v. DIRECTV,* 69 USPQ2d 1865 (Fed. Cir. 2004).

The invention claimed is:

1. An operating method for operating a rolling train for rolling a flat workpiece in a rolling stand of the rolling train, comprising:

providing stand data describing stand parameters of the rolling stand to a control computer for the rolling train;

as part of a rolling schedule calculation, controlling set variables which describe the rolling of the flat workpiece in the rolling stand, the set variables being controlled in the control computer to set a roll nip of the roll stand and an asymmetry of the roll stand during the rolling of the flat workpiece in the rolling stand, the set variables describing a total rolling force, a rolling force difference between a drive side and an operator side, a screw-down difference between the drive side and the operator side, and an offset of the flat workpiece relative to a rolling stand center, the set parameters also including a parameter that sets an additional variable of the rolling stand that influences a rolling contour;

providing initial data to the control computer, the initial data comprising characteristic variables for a width, an average thickness and an average strength of the flat workpiece;

externally prescribing a taper strategy to the control computer;

determining a rolling contour portion based on the total rolling force, the rolling force difference between the drive side and the operator side, the parameter that sets an additional variable of rolling stand, the width of the flat workpiece and the offset of the flat workpiece relative to the rolling stand center, the rolling contour being determined in the control computer;

determining a tilt portion in the control computer, the tilt portion being determined based on the screw-down difference between the drive side and the operator side and a stand frame stretch difference between the drive side and the operator side;

determining at least one of an expected delivery taper and an expected camber for the flat workpiece when the flat workpiece is rolled in the rolling stand using the set variables, the at least one of the expected delivery taper and the expected camber being determined in the control computer based on the rolling contour portion and the tilt portion, using the initial data, the stand data and a taper model;

as part of the rolling schedule calculation, manipulating, by the control computer, at least one of the set variables to produce control information, the control information being produced in accordance with the taper strategy, such that at least one of a desired delivery taper and a desired camber are approximated by the at least one of the expected delivery taper and the expected camber; and transferring the control information from the control computer to a basic automation system of the rolling stand, such that the flat workpiece is rolled in the rolling stand in accordance with the control information.

2. The operating method as claimed in claim 1, wherein the further rolling stand variables is at least one selected from the group consisting of a rolling reverse bending force, a convexity of rollers of the rolling stand, a transposition of the rollers of the rolling stand relative to each other and a displacement of the rollers of the rolling stand relative to each other.

3. The operating method as claimed in claim 1, wherein the set variables further comprise a feed-side tension in the flat workpiece, a delivery-side tension in the flat workpiece, a feed-side tension difference between the drive side and the operator side, a delivery-side tension difference between the drive side and the operator side, a feed-side tension distribution over the width of the flat workpiece, and a delivery-side tension distribution over the width of the flat workpiece.

4. The operating method as claimed in claim 1, wherein the control computer determines a deflection curve portion based on the total rolling force, the rolling force difference between the drive side and the operator side, the parameter that sets an additional variable of rolling stand, the width of the flat workpiece and the offset of the flat workpiece relative to the rolling stand center, the control computer determines a flattening portion based on the total rolling force, the rolling force difference between the drive side and the operator side, and the width of the flat workpiece, and the rolling contour portion is also determined based on a deflection curve portion and the flattening portion.

5. The operating method as claimed in claim 1, wherein the stand parameters of the rolling stand comprise an individual frame stretch characteristic for the drive side and an individual frame stretch characteristic for the operator side.

6. The operating method as claimed in claim 1, wherein the initial data further comprises characteristic variables for a strength taper of the flat workpiece, the characteristic variables being selected from the group consisting of a temperature taper, a thickness taper and a camber.

7. The operating method as claimed in claim 1, wherein the control computer determines the at least one of the desired delivery taper and the desired camber using the initial data.

8. The operating method as claimed in claim 1, wherein the control computer determines the at least one of the expected delivery taper and the expected camber for a plurality of positions over a length of the flat workpiece and varies at least one of the set variables according to the taper strategy.

9. The operating method as claimed in claim 1, wherein the control computer receives further information, the further information being at least one of rolling stand states that occur during rolling of the flat workpiece in the rolling stand, characteristic variables for an actual delivery taper during the rolling of the flat workpiece in the rolling stand, characteristic variables for an actual delivery taper of the flat workpiece after the rolling of the flat workpiece in the rolling stand, characteristic variables for an actual camber of the flat workpiece during the rolling of the flat workpiece in the rolling stand, and characteristic variables for an actual camber of the flat workpiece after the rolling of the flat workpiece in the rolling stand, and the control computer uses the further information for at least one of:

determining at least a portion of the initial data for a subsequent rolling operation of the same flat workpiece in the same or a different rolling stand, adapting the taper model, and visually depicting at least one of the actual delivery taper and the actual camber of the flat workpiece.

10. The operating method as claimed in claim 1, wherein the rolling train comprises a plurality of rolling stands, each rolling stand has a corresponding basic automation system, and control information is provided from the control computer to each basic automation system.

11. A non-transitory computer readable storage medium storing a computer program which, when executed by a control computer for a rolling train for rolling a flat workpiece, causes the control computer to perform a method for operating the rolling train, the method being performed based on stand data describing stand parameters of a rolling stand for the rolling train, based on initial data comprising characteristic variables for a width, an average thickness and an average strength of the flat workpiece and based upon an externally prescribed taper strategy, the method comprising:

as part of a rolling schedule calculation, controlling set variables which describe the rolling of the flat workpiece in the rolling stand, the set variables setting a roll nip of the roll stand and an asymmetry of the roll stand during the rolling of the flat workpiece in the rolling stand, the set variables describing a total rolling force, a rolling force difference between a drive side and an operator side, a screw-down difference between the drive side and the operator side, and an offset of the flat workpiece relative to a rolling stand center, the set parameters also including a parameter that sets an additional variable of the rolling stand that influences a rolling contour;

determining a rolling contour portion based on the total rolling force, the rolling force difference between the drive side and the operator side, the parameter that sets an additional variable of rolling stand, the width of the flat workpiece and the offset of the flat workpiece relative to the rolling stand center;

determining a tilt portion based on the screw-down difference between the drive side and the operator side and a stand frame stretch difference between the drive side and the operator side;

determining at least one of an expected delivery taper and an expected camber for the flat workpiece when the flat workpiece is rolled in the rolling stand using the set variables, the at least one of the expected delivery taper and the expected camber being determined based on the rolling contour portion and the tilt portion, using the initial data, the stand data and a taper model;

as part of the rolling schedule calculation, manipulating at least one of the set variables to produce control information, the control information being produced in accordance with the taper strategy, such that at least one of a desired delivery taper and a desired camber are approximated by the at least one of the expected delivery taper and the expected camber; and transferring the control information from the control computer to a basic automation system of the rolling stand, such that the flat workpiece is rolled in the rolling stand in accordance with the control information.

12. A control computer to operate a rolling train for rolling a flat workpiece based on stand data describing stand parameters of a rolling stand for the rolling train, based on initial data comprising characteristic variables for a width, an average thickness and an average strength of the flat workpiece and based upon an externally prescribed taper strategy, the control computer comprising a processor to:

as part of a rolling schedule calculation, control set variables which describe the rolling of the flat workpiece in the rolling stand, the set variables setting a roll nip of the roll stand and an asymmetry of the roll stand during the rolling of the flat workpiece in the rolling stand, the set variables describing a total rolling force, a rolling force difference between a drive side and an operator side, a screw-down difference between the drive side and the operator side, and an offset of the flat workpiece relative to a rolling stand center, the set parameters also including a parameter that sets an additional variable of the rolling stand that influences a rolling contour;

determine a rolling contour portion based on the total rolling force, the rolling force difference between the drive side and the operator side, the parameter that sets an additional variable of rolling stand, the width of the flat workpiece and the offset of the flat workpiece relative to the rolling stand center;

determine a tilt portion based on the screw-down difference between the drive side and the operator side and a stand frame stretch difference between the drive side and the operator side;

determine at least one of an expected delivery taper and an expected camber for the flat workpiece when the flat workpiece is rolled in the rolling stand using the set variables, the at least one of the expected delivery taper and the expected camber being determined based on the rolling contour portion and the tilt portion, using the initial data, the stand data and a taper model;

as part of the rolling schedule calculation, manipulate at least one of the set variables to produce control information, the control information being produced in accordance with the taper strategy, such that at least one of a desired delivery taper and a desired camber are approximated by the at least one of the expected delivery taper and the expected camber; and transfer the control information from the control computer to a basic automation system of the rolling stand, such that the flat workpiece is rolled in the rolling stand in accordance with the control information.

13. A rolling train for rolling a flat workpiece, comprising:

the control computer as claimed in claim 12.

* * * * *